US007600644B2

(12) United States Patent
McCallum

(10) Patent No.: US 7,600,644 B2
(45) Date of Patent: Oct. 13, 2009

(54) LOCKING DRAIN FILTER FOR FLOOR DRAINS WITH DRAIN WELLS

(76) Inventor: Bryan D. McCallum, 5828 Shady La., Scurry, TX (US) 75158

( * ) Notice: Subject to any disclaimer, the term of this patent is extended or adjusted under 35 U.S.C. 154(b) by 446 days.

(21) Appl. No.: 11/156,933

(22) Filed: Jun. 20, 2005

(65) Prior Publication Data

US 2006/0283792 A1 Dec. 21, 2006

(51) Int. Cl.
*E03F 5/14* (2006.01)
*B01D 29/00* (2006.01)

(52) U.S. Cl. ..... 210/459; 210/460; 210/163; 210/450

(58) Field of Classification Search ..... None
See application file for complete search history.

(56) References Cited

U.S. PATENT DOCUMENTS 2,783,852 A * 3/1957 Sisk ..... 210/165
3,327,326 A * 6/1967 Friedman ..... 4/286
3,383,715 A * 5/1968 De Young ..... 210/163
4,455,693 A * 6/1984 Cuschera ..... 4/286
6,209,572 B1 * 4/2001 Wicklund ..... 210/460

* cited by examiner

*Primary Examiner*—Krishnan S Menon
*Assistant Examiner*—Madeline Gonzalez
(74) *Attorney, Agent, or Firm*—Jackson Walker L.L.P.; Christopher J. Rourk

(57) ABSTRACT

A locking drain filter for floor drains with drain wells is provided. An upper filter portion has external dimensions that allow the upper filter portion to be inserted into a drain line at the bottom of the drain well. A lower filter portion has first external dimensions that allow the lower filter portion to be inserted into the drain line and second external dimensions that allow the lower filter portion to be inserted into the upper filter portion. A compressible gasket has external dimensions that allow the compressible gasket to be inserted into the drain line when the compressible gasket is in an uncompressed state and internal dimensions that allow the compressible gasket to be placed over the second external dimensions of the lower filter portion. A compression device applies a compressive force to the upper filter portion and the lower filter portion, and if the upper filter portion, compressible gasket, and lower filter portion have been inserted into the drain line prior to the application of the compressive force, the compressible gasket is compressed by the upper filter portion and the lower filter portion and expands radially so as to lock the upper filter portion and the lower filter portion into the drain line.

4 Claims, 2 Drawing Sheets

LOCKING DRAIN FILTER FOR FLOOR DRAINS WITH DRAIN WELLS

FIELD OF THE INVENTION

The present invention pertains to the field of plumbing equipment, and more particularly to a locking drain filter for floor drains with drain wells, such as those commonly used in the restaurant and food processing industries.

BACKGROUND OF THE INVENTION

Floor drains are widely used in restaurants, food processing facilities, and other light industrial facilities where water or other fluids may accumulate in significant volumes on the floor of the facility. For example, such floor drains typically include a cover that provides a grate or other water permeable barrier to prevent entry into the drain of items that can block the drainage pipes, and a drain well underneath the barrier to allow the water or other fluids to accumulate in the well if they are accumulating faster than the drain pipe can remove them, as well as to prevent the water or fluids from flowing away from the drain before they have a chance to be removed from the local environment by the drain.

SUMMARY OF THE INVENTION

In accordance with the present invention, a locking drain filter for floor drains and drain wells is provided that overcomes known problems with floor drains.

In particular, a locking drain filter for floor drains and drain wells is provided that does not allow the filter to be easily removed by maintenance or cleaning crews, but which allows suitable authorized persons to remove the filter.

In accordance with an exemplary embodiment of the present invention, a locking drain filter for floor drains with drain wells is provided. An upper filter portion has external dimensions that allow the upper filter portion to be inserted into a drain line at the bottom of the drain well. A lower filter portion has first external dimensions that allow the lower filter portion to be inserted into the drain line and second external dimensions that allow the lower filter portion to be inserted into the upper filter portion. A compressible gasket has external dimensions that allow the compressible gasket to be inserted into the drain line when the compressible gasket is in an uncompressed state and internal dimensions that allow the compressible gasket to be placed over the second external dimensions of the lower filter portion. A compression device applies a compressive force to the upper filter portion and the lower filter portion, and if the upper filter portion, compressible gasket, and lower filter portion have been inserted into the drain line prior to the application of the compressive force, the compressible gasket is compressed by the upper filter portion and the lower filter portion and expands radially so as to lock the upper filter portion and the lower filter portion into the drain line.

The present invention provides many important technical advantages. One important technical advantage of the present invention is a locking drain filter for floor drains and drain wells that allows a plumber or other personnel that have a need to bypass the filter to readily remove the filter, but which prevent maintenance personnel, cleaning crews, or others that may seek to bypass the drain filter to dispose of materials that can block drain lines from readily removing the filter.

Those skilled in the art will further appreciate the advantages and superior features of the invention together with other important aspects thereof on reading the detailed description that follows in conjunction with the drawings.

DETAILED DESCRIPTION OF PREFERRED EMBODIMENTS

Figure 1:
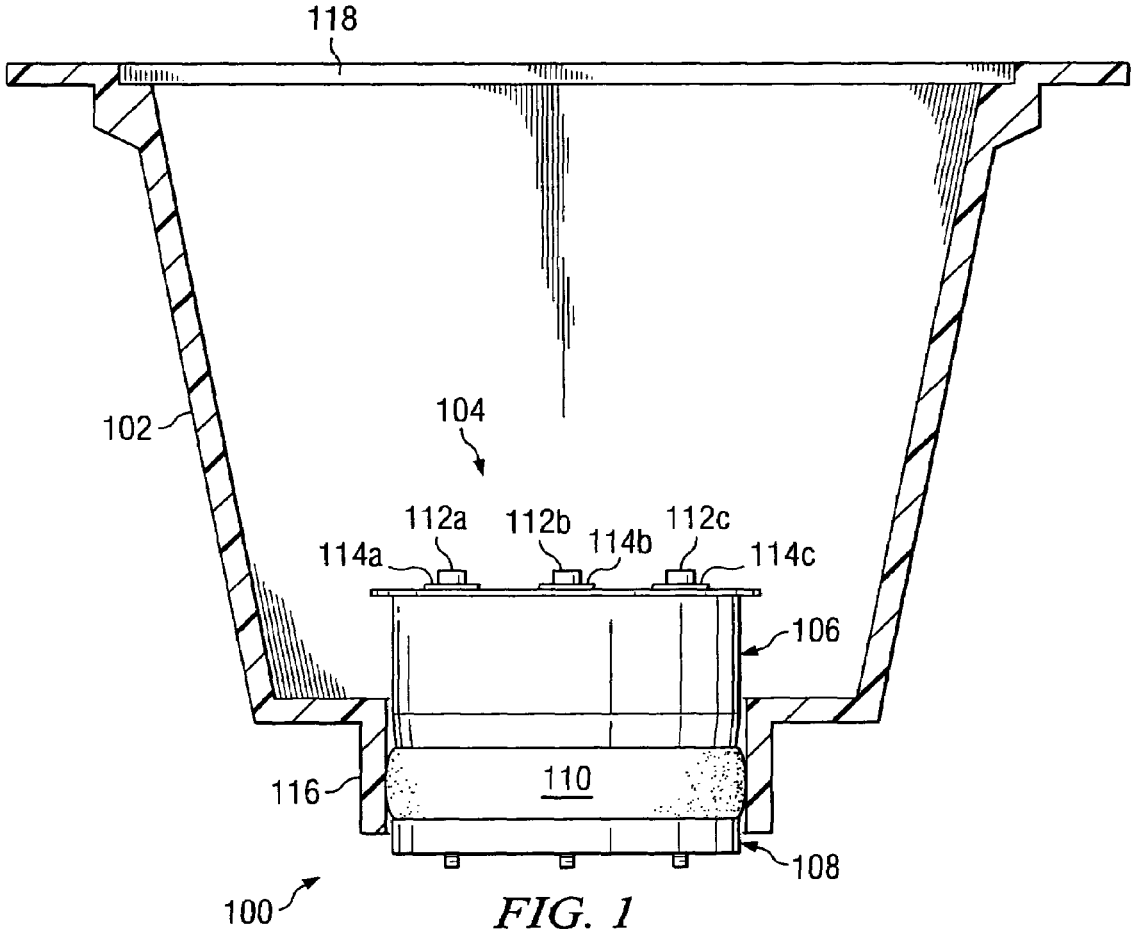
FIG. 1 is a diagram of a drain apparatus in accordance with an exemplary embodiment of the present invention.

In the description that follows, like parts are marked throughout the specification and drawings with the same reference numerals, respectively. The drawing figures might not be to scale, and certain components can be shown in generalized or schematic form and identified by commercial designations in the interest of clarity and conciseness.

FIG. 1 is a diagram of a drain apparatus 100 in accordance with an exemplary embodiment of the present invention. Drain apparatus 100 can be used in conjunction with floor drains, floor sinks, trough drains, or other suitable structures, and includes a removable filter 104 that is not readily removable by personnel other than those that have been approved to remove filter 104.

Drain apparatus 100 includes drain well 102, which can be formed from polyvinyl chloride, (PVC), plastic, metal, or other suitable materials. Drain well 102 allows water or other fluids to collect to drain through filter 104 into drain 116, so as to be removed from an area.

Filter 104 includes filter top 106, filter bottom 108, and compressible gasket 110. Bolts 112*a* through 112*c* are inserted through filter top 106 and into corresponding nuts in filter bottom 108. Washers 114*a* through 114*c* are used in conjunction with bolts 112*a* through 112*c*, and the nuts in filter bottom 108 to allow a compressive force to be exerted on compressible gasket 110 through filter top 106 and filter bottom 108, as will be explained in greater detail herein. In another alternative embodiment, filter 104 can lock into drain 116 in other suitable manners, such as by using an interlocking structure between filter 104 and drain 116, where the structure of filter 104 interlocks with drain 116. While such structures can be amenable to easy removal by maintenance personnel or cleaning crews, the locking structure can be hidden beneath filter top 106, such that the ability to remove filter 104 in this exemplary embodiment is not readily observable. Likewise, a single locking mechanism that inserts into filter 104 and drain well 102 can be used, such as where drain well 102 is fabricated to accommodate filter 104 so as to allow one or more bolts or other suitable devices to be used to directly secure filter 104 to drain 116 or drain well 102, or other locking mechanisms can be used, where suitable. In the exemplary embodiment shown in FIG. 1, filter 104 is configured to be compatible with existing drain apparatuses 100, but a locking filter at the bottom of drain well 102 could also or alternatively be provided by suitable modifications to drain well 102, filter 104, and drain 116.

Filter bottom 108 fits within filter top 106, such that compressible gasket 110 prevents filter bottom 108 from being completely inserted into filter top 106. In this exemplary embodiment, filter top 106 is circular and has an outer diameter that is slightly smaller than the diameter of drain 116, which is also circular, but other suitable configurations can also or alternatively be used. Likewise, filter bottom has a portion that extends into filter top 106, which can also be circular and have a diameter that is smaller than the inner diameter of filter top 106 and the inner diameter of compressible gasket 110, as well as a portion that has a diameter that is larger than the inner diameter of filter top 106 and compressible gasket 110, such that a compressive force can be placed on compressible gasket 110 by filter top 106 and filter bottom 108. As such, as bolts 112*a* through 112*c* are screwed into the corresponding nuts in filter bottom 108, a compressive force is applied to compressible gasket 110, causing compressible gasket 110 to expand in a radial direction. Bolts 112*a* through 112*c* can be configured so as to prevent easy removal, such as by using bolt driver heads that are camouflaged, bolt driver heads that require a special tool to remove bolts 112*a* through 112*c*, bolt driver heads that are recessed into the surface of filter top 106, or using other suitable mechanisms. Likewise, filter top 106 can be inserted completely into drain 116 so as to be flush with the bottom of drain well 102.

As compressible gasket 110 extends in a radial direction, it applies a force against the sides of drain 116 of drain well 102 into which filter 104 is inserted. In this manner, filter 104 can be locked into drain 116 of drain well 102 such that it is not easily removed by personnel who do not have tools for removing bolts 112*a* through 112*c*. Likewise, instead of a compressible gasket 110, other suitable mechanisms can be used to secure filter 104 into drain 116, such as locking mechanisms that are driven by bolts 112*a* through 112*c* or other suitable means that insert a physical structure into drain 116 of drain well 102 from filter 104, by an interlocking structure on filter top 106 that corresponds to an interlocking structure on drain 116, such that filter bottom 108 and compressible gasket 110 are not required, or in other suitable manners.

Filter 104 blocks bulk items that would otherwise fit through drain 116 of drain well 102. For example, it is not uncommon for plastic bags, paper bags, or other large bulky items to be swept or otherwise placed in drain well 102, such as by cleaning personnel or in other manners, even though drain well 102 typically includes a removable cover 118 that is a filter placed on top of drain well 102 that is either not secured or secured by common screws or bolts, and which can be removed by maintenance personnel, cleaning crews, or other personnel. These personnel may allow such large objects to enter drain 116, such as plastic bags, paper, or other objects that can clog the drain pipe that drain 116 of drain well 102 leads to, to avoid the need for picking up such items and disposing of them properly in a solid waste container. Thus, filter 104 prevents such items from entering drain 116 through the bottom of drain well 102, and allows material in drain well 102 to be cleaned by maintenance personnel or cleaning crews without requiring plumbers or other personnel to be dispatched to clean such materials out of a clogged drain pipe connected to drain 116 at the bottom of drain well 102.

In operation, filter 104 can be installed in existing drain apparatuses 100 and allows access to drain 116 of drain well 102 to be restricted to authorized personnel only. While such maintenance personnel or cleaning crews might still be able to access drain well 102 by removing cover 118, any materials that are too big to fit through filter 104 will accumulate in drain well 102, and be cleaned out by the maintenance personnel or cleaning crews. In this manner, plumbers are not required to be dispatched to remove such material from the drain lines that drain well 102 and drain 116 connect to. Filter 104 can also be configured for use with drain apparatuses 100 to simplify the structure of filter 104, such as by providing drain well 102, drain 116 and filter 104 with conventional locking structures, mechanisms or other suitable features.

Figure 2:
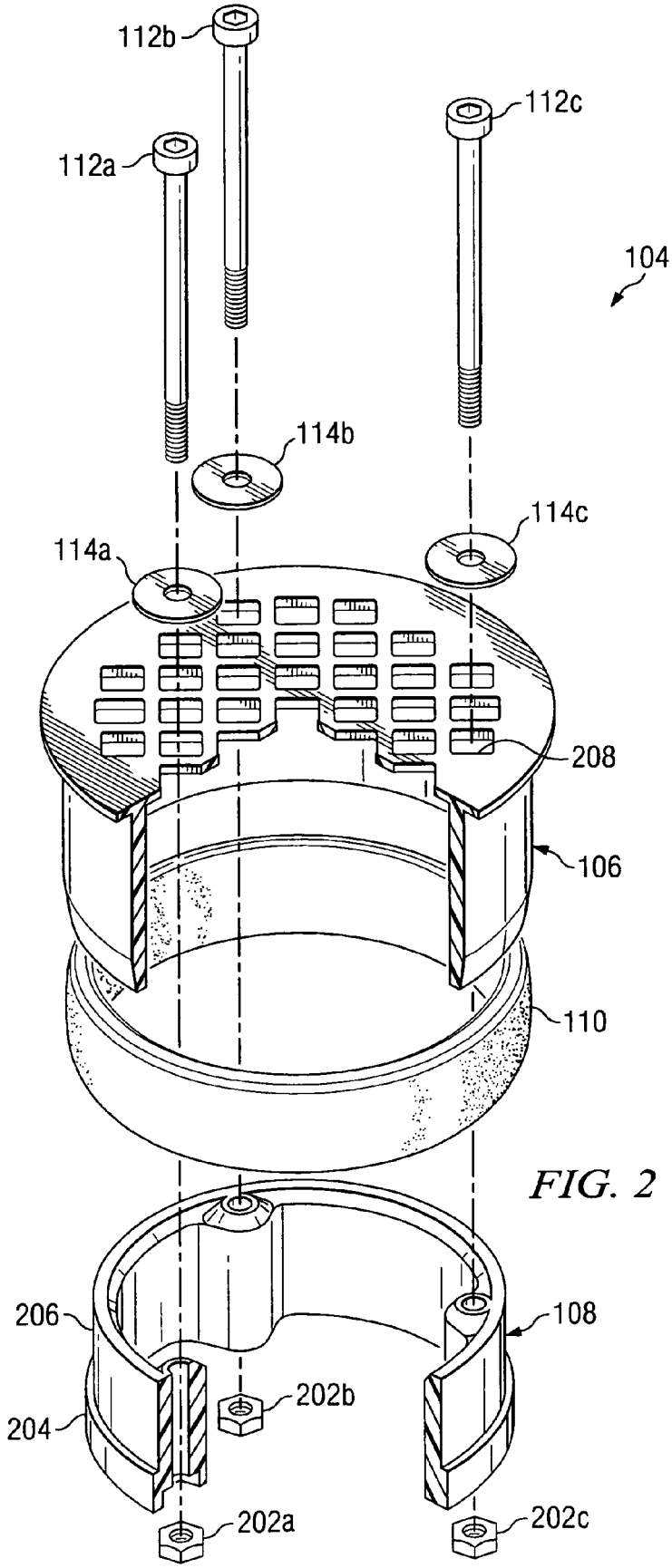
FIG. 2 is an exploded view of filter in accordance with an exemplary embodiment of the present invention.

FIG. 2 is an exploded view of filter 104 in accordance with an exemplary embodiment of the present invention. Filter 104 can be seen with filter top 106 and filter bottom 108, where filter bottom 108 has an inset region 206 with an outer diameter 204 that allows it to slide into the inner diameter of filter top 106 up to the outer diameter 204. Filter top 106 further includes a grate 208 that allows water and other materials or fluids to drain into the drain, but which blocks larger items that can clog the drain.

Bolts 112*a* through 112*c* are inserted through washers 114*a* through 114*c*, respectively, and extend through holes in filter bottom 108. Nuts 202*a* through 202*c* can be secured by epoxy or other suitable means into filter bottom 108. In this manner, filter 104 can be assembled and bolts 112*a* through 112*c* can be screwed into nuts 202*a* through 202*c* so as to allow filter 104 to be placed within the bottom drain interface portion of a drain well 102, but without applying so much force that compressible gasket 110 extends radially. Afterwards, bolts 112*a* through 112*c* can be further turned so as to place a compressive force on compressible gasket 110, which causes compressible gasket 110 to expand radially and exert a force against the wall of drain 116 or the drain line, depending upon the specific configuration of drain well 102, drain 116 and the drain line to which it interfaces. In this manner, filter 104 can be made difficult to remove without proper tools, which would not typically be carried by maintenance personnel, cleaning crew, or other individuals who might be inclined to try to dispose of bulky items through drain well 102, such as by lifting a cover on a drain well 102.

The exemplary embodiment of filter 104 in FIG. 2 is adapted for use with existing drain apparatuses, such as where it would be necessary to remove the existing drain apparatus in order to use a filter that locks directly into the drain apparatus. Likewise, filter 104 can be configured so as to lock directly into a drain apparatus, such as through the use of bolts 112*a* through 112*c* or other suitable bolts that extend directly into the drain or drain well, such as where the drain apparatus 100 is supplied with filter bottom 108 attached to drain well 102 or drain 116 at outer diameter 204, in a manner where compressible gasket 110 and a separate filter bottom 108 are not required, or in other suitable manners.

Although exemplary embodiments of a system and method of the present invention have been described in detail herein, those skilled in the art will also recognize that various substitutions and modifications can be made to the systems and methods without departing from the scope and spirit of the appended claims.

What is claimed is:

1. A locking drain filter for floor drains with drain wells comprising:

an upper filter portion having external dimensions that allow the upper filter portion to be inserted into a drain line at the bottom of the drain well;

a lower filter portion having first external dimensions that allow the lower filter portion to be inserted into the drain line and second external dimensions that allow the lower filter portion to be inserted into the upper filter portion;

a compressible gasket having external dimensions that allow the compressible gasket to be inserted into the drain line when the compressible gasket is in an uncompressed state and internal dimensions that allow the compressible gasket to be placed over the second external dimensions of the lower filter portion;

a compression device applying a compressive force to the upper filter portion and the lower filter portion so as to cause the compressible gasket to be compressed by the upper filter portion and the lower filter portion and to expand radially so as to lock the upper filter portion and the lower filter portion into the drain line if the upper filter portion, compressible gasket, and lower filter portion have been inserted into the drain line prior to the application of the compressive force;

wherein the compression device further comprises a plurality of bolts that extend through the upper filter portion and the lower filter portion to mate with a corresponding plurality of nuts in the lower filter portion, and wherein the plurality of bolts extend through a corresponding plurality of filter grate holes, and further comprising a plurality of washers to prevent a head of each of the plurality of bolts from passing through the corresponding grate hole.

2. The locking drain filter of claim 1 wherein the head of each bolt requires a non-conventional driver to rotate the bolt, so as to prevent the bolt from being removed through the use of a commonly-available screwdriver or a commonly-available wrench.

3. The locking drain filter of claim 1 wherein the head of each bolt is flush with the upper filter portion so as to prevent the bolt from being removed through the use of a commonly-available wrench.

4. The locking drain filter of claim 1 wherein the upper filter portion further comprises a plurality of grate holes.

* * * * *

UNITED STATES PATENT AND TRADEMARK OFFICE

CERTIFICATE OF CORRECTION

PATENT NO. : 7,600,644 B2
APPLICATION NO. : 11/156933
DATED : October 13, 2009
INVENTOR(S) : Bryan D. McCallum It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 771 days.

Signed and Sealed this

Fifth Day of October, 2010

David J. Kappos

David J. Kappos
*Director of the United States Patent and Trademark Office*